US007242384B2

(12) United States Patent
Yamamoto et al.

(10) Patent No.: US 7,242,384 B2
(45) Date of Patent: Jul. 10, 2007

(54) IMAGE PROCESSING DEVICE, AND IMAGE DISPLAY DEVICE PROVIDED WITH SUCH AN IMAGE PROCESSING DEVICE

(75) Inventors: Yoichi Yamamoto, Nara (JP); Hiroshi Suzuki, Nara (JP); Yasuhiro Yoshida, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 456 days.

(21) Appl. No.: 09/752,683

(22) Filed: Jan. 3, 2001

(65) Prior Publication Data

US 2001/0008395 A1 Jul. 19, 2001

(30) Foreign Application Priority Data

Jan. 14, 2000 (JP) ..... 2000-005386
Nov. 27, 2000 (JP) ..... 2000-358791

(51) Int. Cl.
*G09G 3/36* (2006.01)

(52) U.S. Cl. ..... 345/102; 345/50; 345/55; 345/84; 345/87; 345/88; 345/103; 345/9; 348/687; 348/688

(58) Field of Classification Search ..... 345/102–103, 345/84, 87–88, 90, 92, 50, 55, 9; 348/687, 348/688, 673–676; 382/167, 162
See application file for complete search history.

(56) References Cited

U.S. PATENT DOCUMENTS 5,574,664 A * 11/1996 Feasey ..... 702/107
5,623,277 A * 4/1997 Lippmann et al. ..... 345/87
5,793,221 A * 8/1998 Aoki ..... 324/770
5,844,540 A * 12/1998 Terasaki ..... 345/102
6,100,861 A * 8/2000 Cohen et al. ..... 345/88
6,157,143 A * 12/2000 Bigio et al. ..... 315/307
6,275,205 B1 * 8/2001 Winer ..... 345/82
6,295,415 B1 * 9/2001 Kashiyama et al. ..... 396/222
6,348,910 B1 * 2/2002 Yamamoto et al. ..... 345/100
6,366,270 B1 * 4/2002 Evanicky ..... 345/589
6,388,648 B1 * 5/2002 Clifton et al. ..... 345/4
6,388,716 B1 * 5/2002 Tsuzuki et al. ..... 348/180

FOREIGN PATENT DOCUMENTS

| | | | |
|---|---|---|---|
| JP | 02-034817 | | 2/1990 |
| JP | 03-153211 | | 7/1991 |
| JP | 07-294889 | | 11/1995 |
| JP | 08-313879 | * | 11/1996 |
| JP | 09-185036 | | 7/1997 |
| JP | 10-010485 | * | 1/1998 |
| JP | 09-030434 | * | 2/1999 |
| JP | 11-134478 | | 5/1999 |
| JP | 11-212056 | | 8/1999 |

* cited by examiner

*Primary Examiner*—Richard Hjerpe
*Assistant Examiner*—Leonid Shapiro
(74) *Attorney, Agent, or Firm*—Nixon & Vanderhye P.C.

(57) ABSTRACT

In an image display device, how R, G, and B light is emitted to display an image on a display panel is measured with a sensor, and, according to the measurement value obtained from the sensor, the power with which to drive a light source that supplies light needed for the display operation of the display panel is varied so that the brightness or chromaticity of the display panel is corrected.

15 Claims, 10 Drawing Sheets

IMAGE PROCESSING DEVICE, AND IMAGE DISPLAY DEVICE PROVIDED WITH SUCH AN IMAGE PROCESSING DEVICE

BACKGROUND OF THE INVENTION

1. Field of the Invention

The present invention relates to an image processing device, and to an image display device provided with such an image processing device.

2. Description of the Prior Art

In recent years, as electronic devices designed mainly to process color images become popular, it has become easy to handle color images not only in specialized fields such as computer graphics-based designing but also in general office work. However, when the data of a color image created on a personal computer or with a digital still camera is transferred by e-mail so that the receiver stores the received data on a HDD device, a floppy disk, or a recording medium built in a digital still camera and then outputs it as a color image, the colors usually do not match between the sender and the receiver. This makes it difficult to check the colors of an image on a monitor. As a means to solve this inconvenience, color management systems have been devised and have been attracting much attention.

A color management system aims to eliminate color differences from one device to another by the use of a common color space. This is based on the thought that colors identified with identical coordinates in an identical color space appear identical (i.e. those colors match), and accordingly a color management system evaluates all colors in an identical color space and attempts to match colors by making their coordinates identical. One method commonly used today is to use a CIE-XYZ color space as a color space and correct color differences from one device to another by the use of XYZ tristimulus values, i.e. coordinates identifying specific points within the color space. A technique for achieving color matching based on this method is disclosed, for example, in Japanese Patent Application Laid-Open No. H11-134478.

However, inconveniently, even though a color management system as described above achieves color matching under specific ambient-light conditions, a variation in the environmental and other conditions under which an image is observed causes a change in how the image appears.

FIG. 10 is a diagram illustrating a case in which identical images displayed on different personal computers in different environments are observed by the use of a color management system. Here, user A (sender) transmits an image 102 displayed on the monitor 101 of the sender-side personal computer to user B (receiver). The image transmitted from user A is received by user B, and is displayed as an image 202 on the monitor 201 of the receiver-side personal computer.

In such a case, there is almost no probability that the ambient-light conditions 103 around the monitor 101 of the sender-side personal computer are identical with the ambient-light conditions 203 around the monitor 201 of the receiver-side personal computer. Thus, in this case, even though the color management system achieves color matching between the images 102 and 202 under specific ambient-light conditions, a variation in ambient-light conditions causes a change in how the images appear, destroying color matching.

Moreover, in cases where transmissive liquid crystal display devices are used as the monitors 101 and 201 of the personal computers mentioned above, the environmental and other conditions under which the images are observed may vary because of variations with time in the characteristics of the color filters of the transmissive liquid crystal display devices, or variations with ambient temperature or with time in the characteristics of the backlight sources thereof. Such variations also cause a change in how the images appear, and thus destroy color matching. The factors that cause variations in the environmental and other conditions under which the images are observed include variations with time in the brightness and chromaticity of the backlight, variations with temperature in the brightness of the backlight, and the like.

FIG. 11 is a diagram showing the variation with time of the brightness (i.e. the brightness preservation ratio) of the backlight of a typical transmissive liquid crystal display device. In this figure, along the horizontal axis is taken the accumulated lit ("on") period of the backlight source, and along the vertical axis is taken the brightness preservation ratio thereof. The brightness preservation ratio is the ratio of the current brightness of the backlight source at a given time to the initial brightness (100%) thereof. As shown in this figure, the brightness preservation ratio decreases with the accumulated lit period. Generally, the period over which the brightness preservation ratio of the backlight source reduces to 50% is evaluated as the operating life thereof.

FIG. 12 is a diagram showing the variation with time of the chromaticity (i.e. the chromaticity shift) of the backlight of a typical transmissive liquid crystal display device. In this figure, along the horizontal axis is taken the accumulated lit period of the backlight source, and along the vertical axis is taken the chromaticity shift (X, Y) thereof. The chromaticity shift (X, Y) is an important parameter that indicates the degree in which the current chromaticity of the backlight source at a given time has varied from the initial chromaticity thereof. Generally, the chromaticity, represented by values X and Y, of the backlight source increase with the accumulated lit period thereof.

FIG. 13 is a diagram showing the temperature dependence of the brightness of the backlight of a transmissive liquid crystal display device. In this figure, along the horizontal axis is taken the tube wall temperature of the backlight source, and along the vertical axis is taken the brightness thereof. As shown in this figure, the brightness of the backlight source varies greatly with the tube wall temperature thereof. The tube wall temperature of the back light source varies with the period over which it has been lit and with ambient temperature.

FIG. 14 is a diagram showing an example of the chromaticity coordinate system of a color filter of a transmissive liquid crystal display device. In this figure, along the horizontal axis is taken the chromaticity x of the color filter, and along the vertical axis is taken the chromaticity y thereof. In this figure, points A, B, C, and D indicate the green point, red point, blue point, and white point, respectively, and the triangle enclosing points A, B, C, and D represents the chromaticity (x, y) of the color filter.

The parameters mentioned above (the brightness and chromaticity of the backlight, the chromaticity of the color filter, and the like) vary differently from one transmissive liquid crystal display device to another. Therefore, even if color matching is achieved between images under specific conditions, it is liable to be destroyed by a variation in the environmental and other conditions under which the images are observed, or a variation with time in those parameters.

Moreover, on different personal computers, identical images are displayed and observed by their users under different environmental and other conditions.

Therefore, even if a color management system achieves color matching between images displayed on different personal computers under specific anbient-light conditions and at a given time, it is difficult to maintain the color matching between the images against the deterioration with time of the devices used, because different personal computers differ in the period over which their monitor has been used and in their characteristics.

SUMMARY OF THE INVENTION

An object of the present invention is to provide an image display device that achieves satisfactory color matching irrespective of variations in the environmental and other conditions under which an image is observed, variations with time in the characteristics of a color filter, or variations with ambient temperature or with time in the characteristics of a backlight source.

To achieve the above object, according to one aspect of the present invention, an image display device is provided with: a liquid crystal panel for displaying an RGB image; a light source for supplying light that the liquid crystal panel needs for display operation thereof; and an optical sensor for measuring how the liquid crystal panel is emitting R, G, and B light. Here, the lighting of the light source is controlled according to the measurement value obtained from the optical sensor in order to correct the brightness or chromaticity or both of the liquid crystal panel.

According to another aspect of the present invention, an image processing device is provided with: varying means for varying how R, G, and B light is emitted to display an image on a display panel; and a sensor for measuring how the R, G, and B light is emitted to display the image. Here, the brightness or chromaticity or both of the image is corrected by controlling the varying means according to the measurement value obtained from the sensor.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Hereinafter, embodiments of the present invention will be described, taking up transmissive liquid crystal display devices as examples.

First Embodiment

Figure 1A:
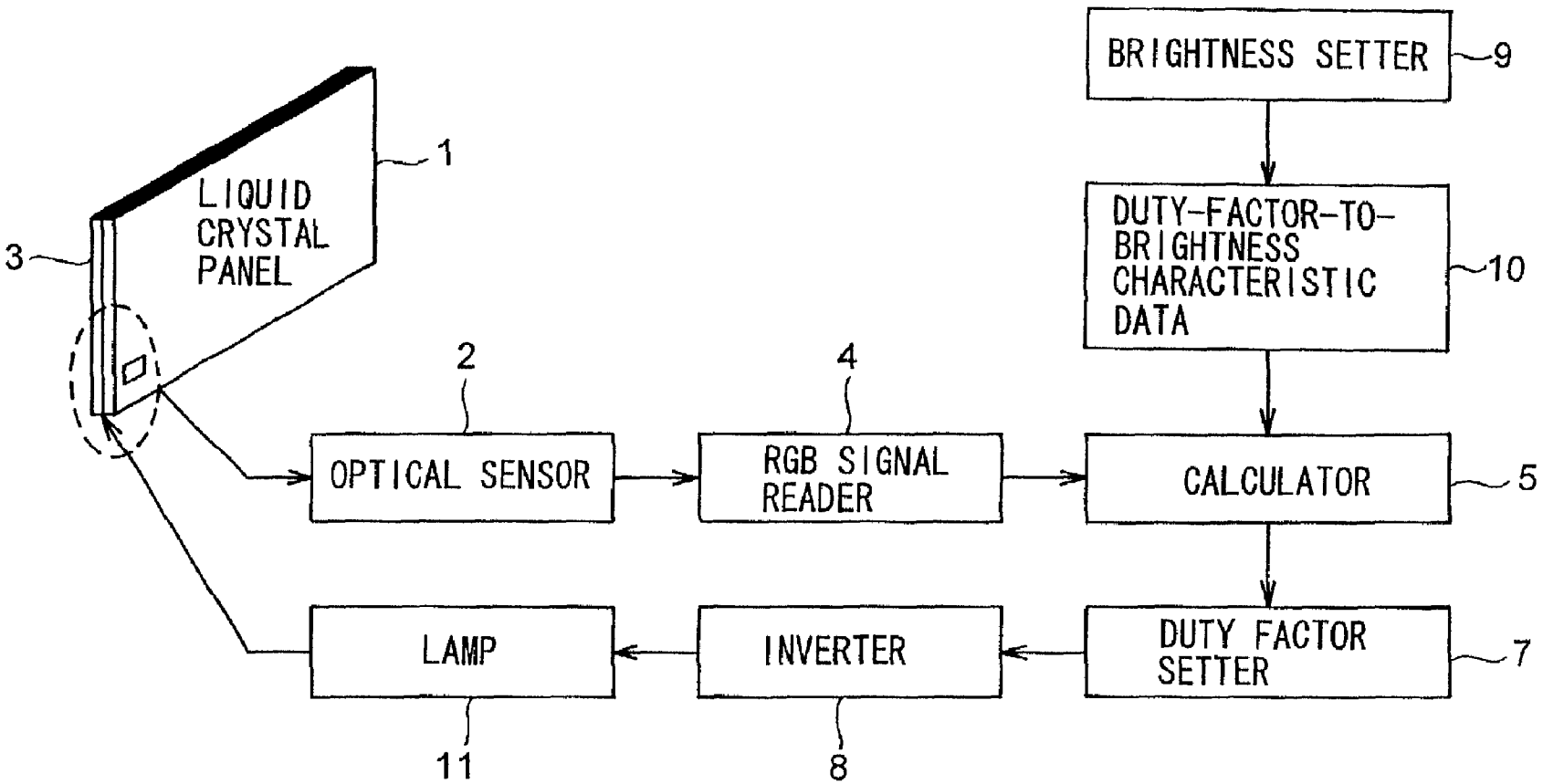
FIG. 1A is a conceptual diagram of a first embodiment of the invention.

In a transmissive liquid crystal display device embodying the invention, the lighting of the backlight is controlled on the basis of the brightness of the image currently displayed, and thereby the brightness of the liquid crystal display device is corrected. The details will be described below with reference to the drawings. FIG. 1A is a conceptual diagram of the transmissive liquid crystal display device of a first embodiment of the invention, and FIG. 1B is an enlarged view of the portion encircled with a broken line in FIG. 1A.

Figure 1B:
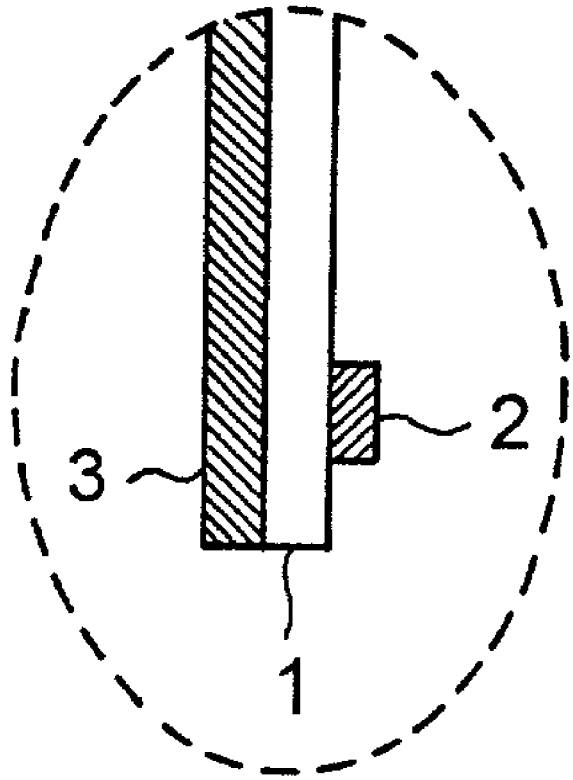
FIG. 1B is an enlarged view of the portion encircled with a broken line in FIG. 1A.

As shown in FIGS. 1A and 1B, a transmissive liquid crystal display device embodying the invention includes a liquid crystal panel 1. The liquid crystal panel 1 has an optical sensor 2 fitted on the front surface thereof, and has a backlight 3 fitted on the back surface thereof. The backlight 3 supplies light needed for the display operation of the liquid crystal panel 1. The optical sensor 2 measures how the liquid crystal panel 1 is emitting R, G, and B light for the purpose of brightness correction. The measurement value obtained from the optical sensor 2 is, by an RGB signal reader 4, converted into a value representing brightness, which is then fed, as a value representing the current brightness of the liquid crystal panel 1, to a calculator 5.

On the other hand, a brightness setter 9 permits entry of the brightness specified by the user (within the range of duty factors from 0% to 100%). The calculator 5 is realized, for example, with a microprocessor, and serves to convert the value entered into the brightness setter 9 into a value representing the specified brightness of the liquid crystal panel 1 by referring to duty-factor-to-brightness characteristic data 10 previously stored in the form of a data table in a memory.

The calculator 5 calculates the difference between the current brightness value and the specified brightness value of the liquid crystal panel 1, and feeds the calculation result, together with the current brightness value of the liquid crystal panel 1, to a duty factor setter 7. The duty factor setter 7 feeds an inverter with a pulse signal whose duty factor depends on the calculation result of the calculator 5 (i.e. the difference between the current and specified brightness values). According to this pulse signal, the inverter 8 produces a driving current and a driving voltage to be supplied to a lamp 11 constituting the backlight 3. The circuit configuration and the operation of the inverter 8 will be described in detail later.

Figure 2:
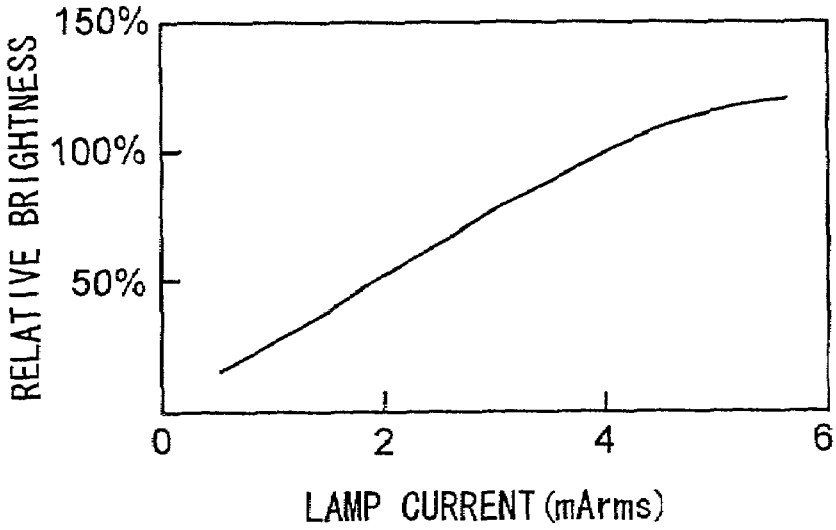
FIG. 2 is a diagram showing a typical relationship between the lamp current of the backlight and the relative brightness in a transmissive liquid crystal display device.

Now, the relationship between the lamp current that is supplied to the lamp 11 constituting the backlight 3 and the relative brightness of the liquid crystal panel 1 will be described. FIG. 2 is a diagram showing a typical relationship between the lamp current and the relative brightness. In this figure, along the horizontal axis is taken the lamp current, and along the vertical axis is taken the relative brightness of the liquid crystal panel 1. As shown in this figure, generally, as the lamp current increases, the relative brightness of the liquid crystal panel 1 increases.

Thus, the duty factor setter 7 sets the duty factor of the pulse signal in such a way that, when the difference between the current and specified brightness values is negative, the lamp current supplied to the lamp 11 is increased to eliminate the difference and, when the difference is positive, the lamp current is decreased to eliminate the difference. This makes it possible to control the brightness of the liquid crystal panel 1 to be kept always at the specified brightness.

In this way, by controlling the inverter 8 in such a way as to appropriately increase or decrease the lamp current supplied to the lamp 11, it is possible to correct the brightness of the backlight 3. This control method permits correction of the variation with time of the brightness of the backlight 3 of the transmissive liquid crystal display device.

Figure 3:
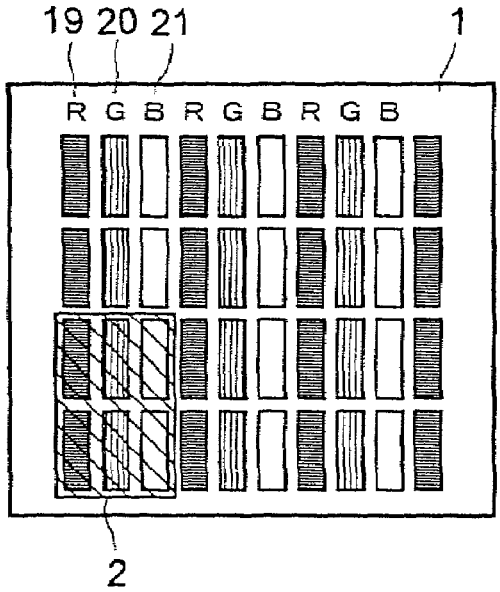
FIG. 3 is a diagram showing, in a plan view, the structure of the transmissive liquid crystal display device of the first or a second embodiment of the invention.

Next, how the brightness of the transmissive liquid crystal display device is measured will be described. FIG. 3 is a diagram showing, in a plan view, the structure of (a portion of) the color filter of a transmissive liquid crystal display device embodying the invention. As shown in this figure, the optical sensor 2 is fitted right above, i.e. perpendicularly above, an area covering a part of a red (R) column 19, a part of a green (G) column 20, and a part of a blue (B) column 21 of the color filter of the transmissive liquid crystal display device. In FIG. 3, the optical sensor 2 is shown as having a light-sensing area covering two R, two G, and two B dots (six dots in total); however, in practice, it has only to have a light-sensing area covering at least one R, one G, and one B dots (three dots in total). Thus, the optical sensor 2 occupies only a tiny portion of the display surface, and therefore its presence is unnoticeable to the user of the transmissive liquid crystal display device.

Figure 4:
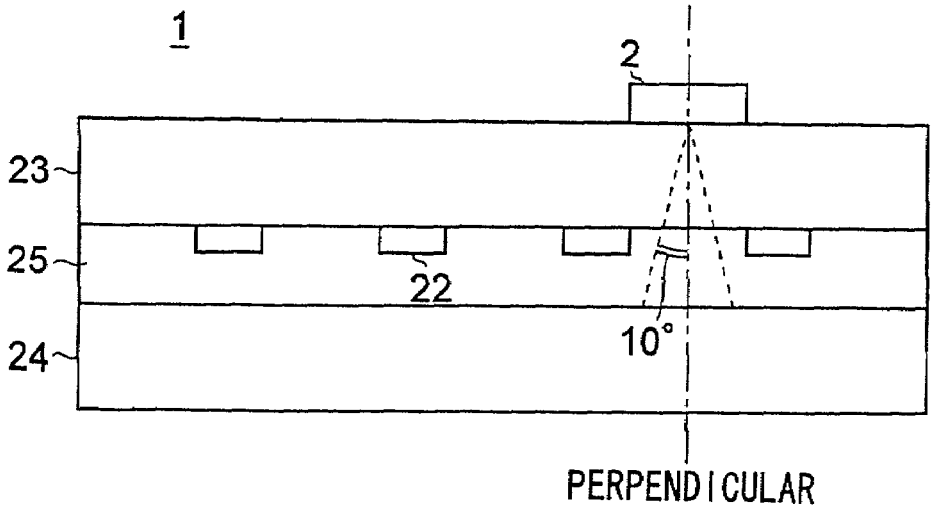
FIG. 4 is a diagram illustrating how brightness is measured in the first or second embodiment.

FIG. 4 is a diagram illustrating how brightness is measured with the optical sensor 2, and schematically shows the sectional structure of the liquid crystal panel 1. As shown in this figure, the liquid crystal panel 1 has a liquid crystal layer 25 sealed between a display-surface-side glass plate 23 and a backlight-side glass plate 24, and has a plurality of electrodes 22 arranged on the liquid crystal layer 25 side surface of the display-surface-side glass plate 23.

The optical sensor 2 is placed right in front of a pixel of the liquid crystal panel 1 so as to measure brightness and chromaticity within 10° upward, downward, leftward, and rightward of a line perpendicular to the liquid crystal panel 1. Thus, the optical sensor 2 measures the brightness of light passing within a limited viewing angle. The optical sensor 2 is always measuring brightness as long as the transmissive liquid crystal display device is being used.

Figure 5:
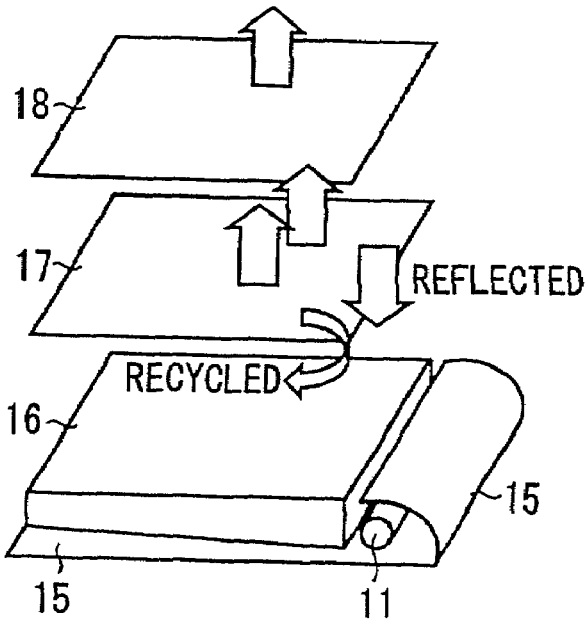
FIG. 5 is a diagram showing an example of the structure of the backlight 3 used in the present invention.

FIG. 5 is a diagram showing an example of the structure of the backlight 3. As shown in this figure, the backlight 3 is composed of a lamp 11, a reflective sheet 15, a light guide member 16, a diffusive sheet 17, and a DBEF (dual brightness enhancement film, a proprietary product of 3M Co., USA) 18. The light emitted from the lamp 11 is reflected from the reflective sheet 15, and is then supplied through the light guide member 16, the diffusive sheet 17, and the DBEF 18 to the liquid crystal panel 1. The light reflected from the liquid crystal panel 1 is recycled.

Figure 6:
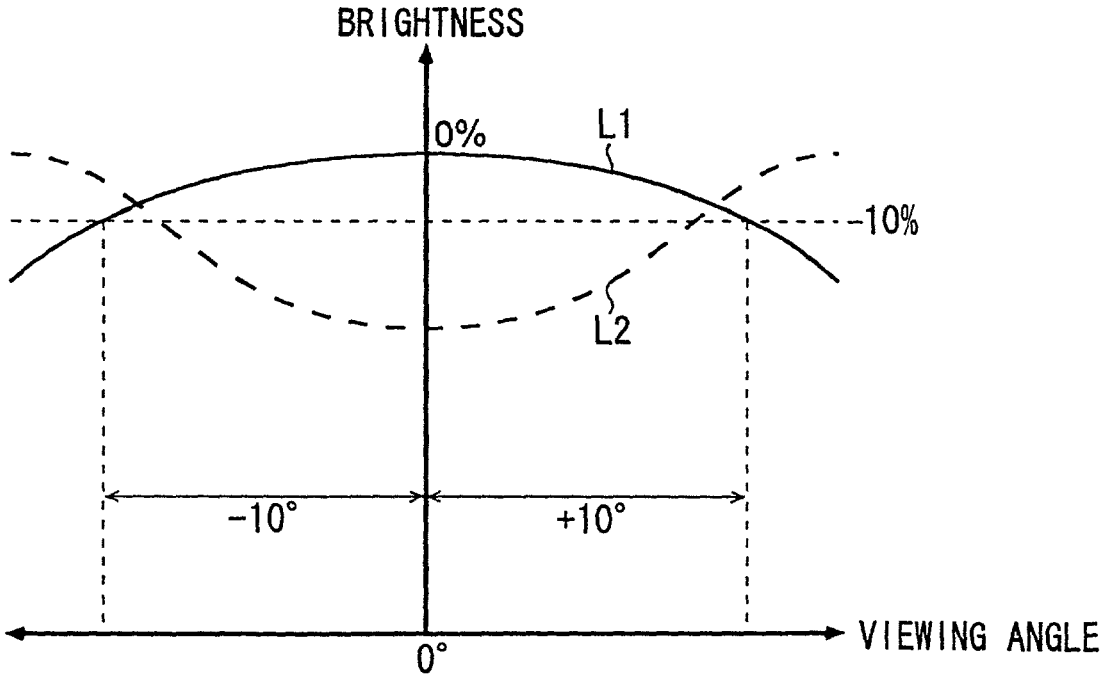
FIG. 6 is a diagram illustrating the viewing-angle dependence of the brightness of the transmissive liquid crystal display device of the present invention.

FIG. 6 is a diagram showing the viewing-angle dependence of the brightness of the backlight 3 having the diffusive sheet 17. In this figure, along the horizontal axis is taken the viewing angle, and along the vertical axis is taken the brightness. In this figure, a solid line L1 represents the brightness of the backlight 3 with the diffusive sheet 17, and, for comparison, a broken line L2 represents the brightness of the backlight 3 without the diffusive sheet 17.

As shown in FIG. 6, if the optical sensor 2 is so placed as to measure characteristics within more than 10° upward, downward, leftward, and rightward of a line perpendicular to the liquid crystal panel 1, the brightness of the backlight 3 as detected by the optical sensor 2 lowers, and thus the S/N ratio of the output signal of the optical sensor 2 deteriorates. As a result, if the measurement value obtained from the optical sensor 2 under such conditions is converted into a current brightness value by the RGB signal reader 4, and the lighting of the lamp 11 is controlled by controlling the inverter 8 on the basis of this current brightness value and the correction parameter calculated by the calculator 5, the output signal of the optical sensor 2 is undercorrected.

By contrast, when the optical sensor 2 is so placed as to measure brightness and chromaticity within 10° upward, downward, leftward, and rightward of a line perpendicular to the liquid crystal panel 1, it is always possible to detect a highly accurate brightness/chromaticity correction signal. It has been verified that this contributes to a remarkably higher degree of brightness and chromaticity matching between sender-side and receiver-side images.

As described above, the liquid crystal panel 1 exhibits viewing-angle dependence, which causes an image to appear different in colors and brightness when viewed from different angles with respect to the panel. However, according to the present invention, the optical sensor 2 is so placed as to have a limited viewing angle. This helps eliminate viewing-angle dependence, and thereby makes it possible to achieve correction on the basis of brightness as measured right in front. Thus, it is always possible to detect a highly accurate brightness/chromaticity correction signal.

In practice, as the optical sensor 2 that measures the brightness of the transmissive liquid crystal display device, it is possible to use either an optical sensor with an unlimited viewing angle or one with a limited viewing angle. In cases where an optical sensor with an unlimited viewing angle is used as the optical sensor 2, the output of the sensor 2 needs to be converted into a signal proportional to the measured brightness through correction according to the characteristics of the optical sensor 2. The RGB signal reader 4 performs just such conversion.

On the other hand, in cases where an optical sensor with a limited viewing angle, such as a model BS120 or BS520 silicon photodiode (blue-sensitive photodiode, manufactured by Sharp Corporation), is used as the optical sensor 2, the measurement result as it is is proportional to the measured brightness. This conveniently makes the RGB signal reader 4 substantially needless.

Suppose that, on a sender-side personal computer, the brightness of an image is corrected by using a model BS120 or BS520 silicon photodiode (manufactured by Sharp Corporation) with a limited viewing angle. Then, a comparison between a case where the image is transmitted to a receiver-side personal computer with a brightness-corrected image signal and a case where the image is transmitted to the receiver-side personal computer without a brightness-corrected image signal verifies that a higher degree of brightness matching between the images displayed on the sender-side and receiver-side personal computers is achieved in the former case.

Second Embodiment

In a transmissive liquid crystal display device embodying the invention, the lighting of the backlight is controlled also on the basis of the lamp temperature of the backlight, and thereby the chromaticity of the liquid crystal display device is corrected.

The lamp chromaticity of the backlight depends heavily on its operating temperature. Therefore, by controlling the backlight in such a way that the lamp temperature is kept constant, it is possible to obtain, not only constant brightness as described previously in connection with the first embodiment, but also constant chromaticity. The details will be described below with reference to the drawings. To simplify descriptions, such components as are found also in the first embodiment are identified with the same reference numerals.

Figure 7:
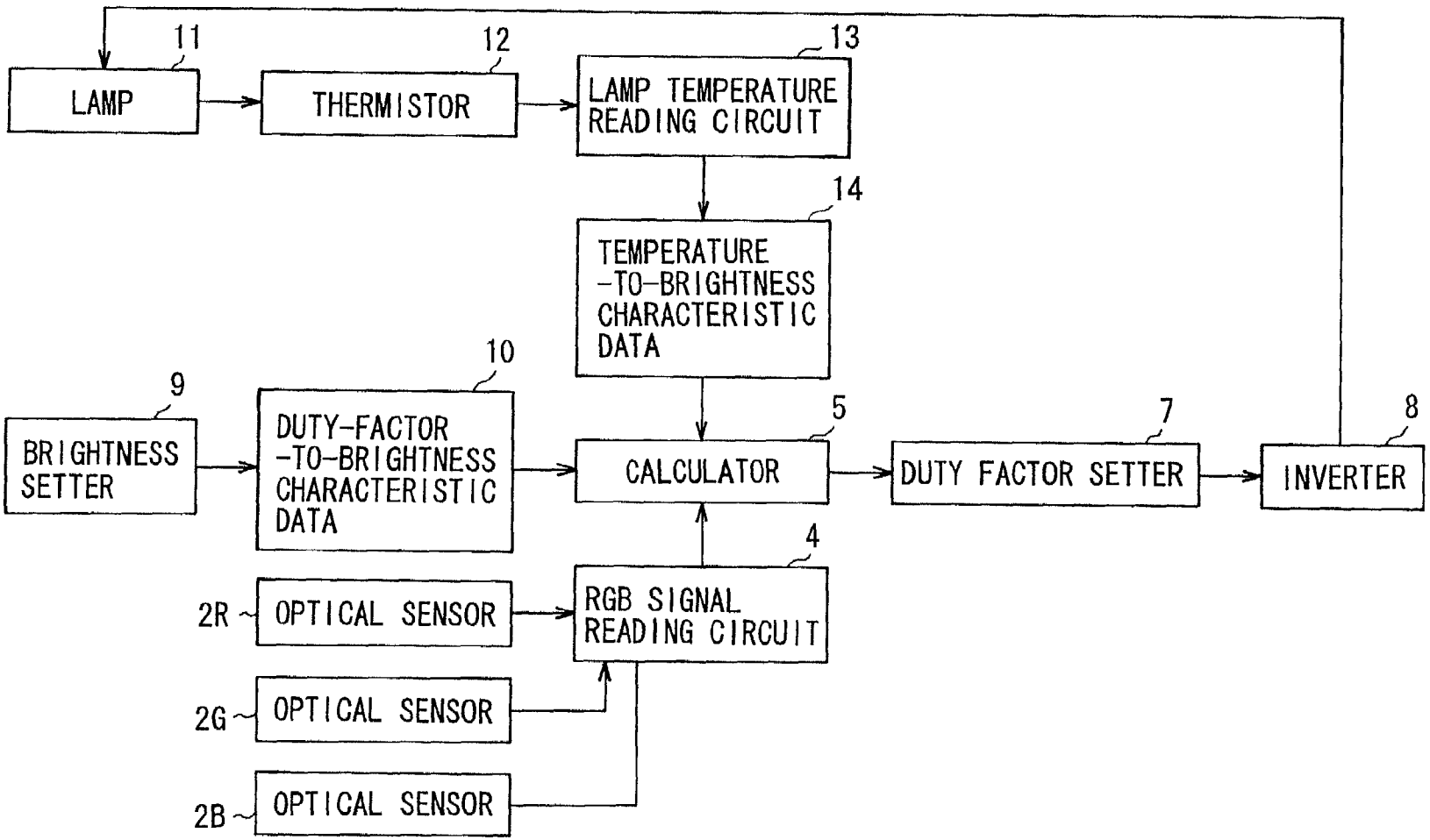
FIG. 7 is a conceptual diagram of the second embodiment.

FIG. 7 is a block diagram of the transmissive liquid crystal display device of a second embodiment of the invention. In this embodiment, to keep not only brightness but also chromaticity constant, three optical sensors 2R, 2G, and 2B are used one for each of R, G, and B. In this figure, an RGB signal reading circuit 4 converts the signals representing the brightness of R, G, and B as read by the optical sensors 2R, 2G, and 2B, respectively, into a brightness value and a chromaticity value, and feeds them, as current brightness and chromaticity values of the liquid crystal panel 1, to the calculator 5.

On the other hand, a lamp 11 has a thermistor 12 fitted on the tube wall thereof. The thermistor 12 exhibits varying resistances according to the surface temperature of the lamp 11, and thus serves as a temperature sensor. On the basis of the resistance of the thermistor 12, a lamp temperature reading circuit 13 calculates a value representing the surface temperature of the lamp 11. The calculator 5 is realized, for example, with a microprocessor, and serves to convert the lamp surface temperature value into a value representing the specified brightness of the liquid crystal panel 1 by referring to temperature-to-brightness characteristic data 14 previously stored in the form of a data table in a memory.

Figure 13:
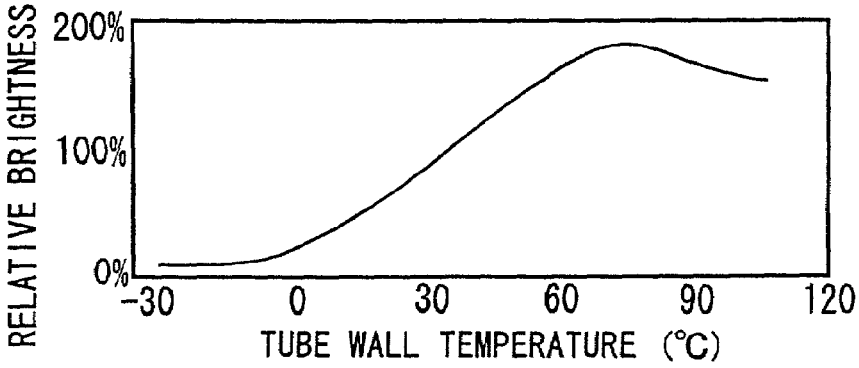
FIG.13 PRIOR ART
FIG. 13 is a diagram showing the temperature dependence of the brightness of the backlight of a transmissive liquid crystal display device.
Figure 14:
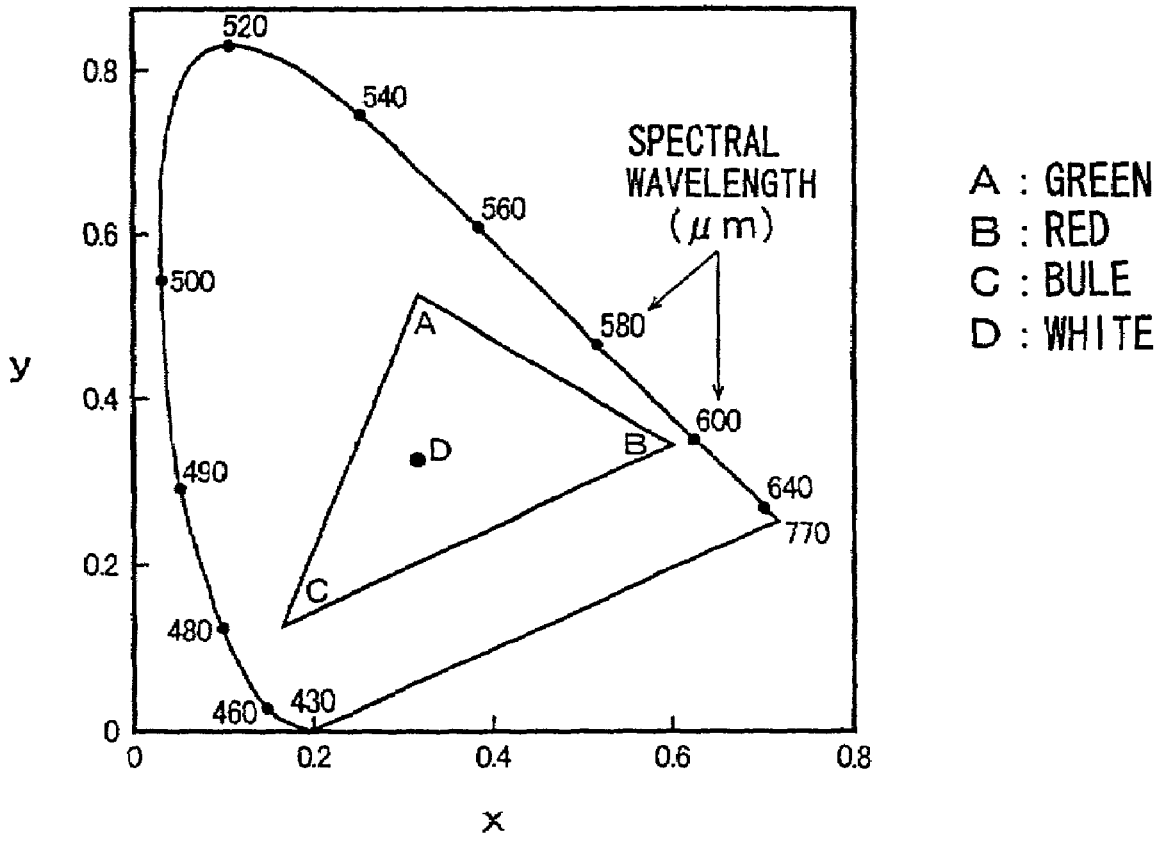
FIG. 14 PRIOR ART
FIG. 14 is a diagram showing an example of the chromaticity coordinate system of a color filter of a transmissive liquid crystal display device.

The calculator 5 controls the lamp 11 in such a way that its surface temperature is kept as constant as possible in the same manner as in the first embodiment with respect to brightness and on the basis of the temperature-dependence (see FIG. 13) of the backlight brightness with respect to chromaticity. In this way, by measuring the color filter characteristics of the transmissive liquid crystal display device beforehand and making the calculator 5 perform appropriate correction, it is possible to correct brightness or chromaticity through voltage control of the lamp 11.

Figure 8:
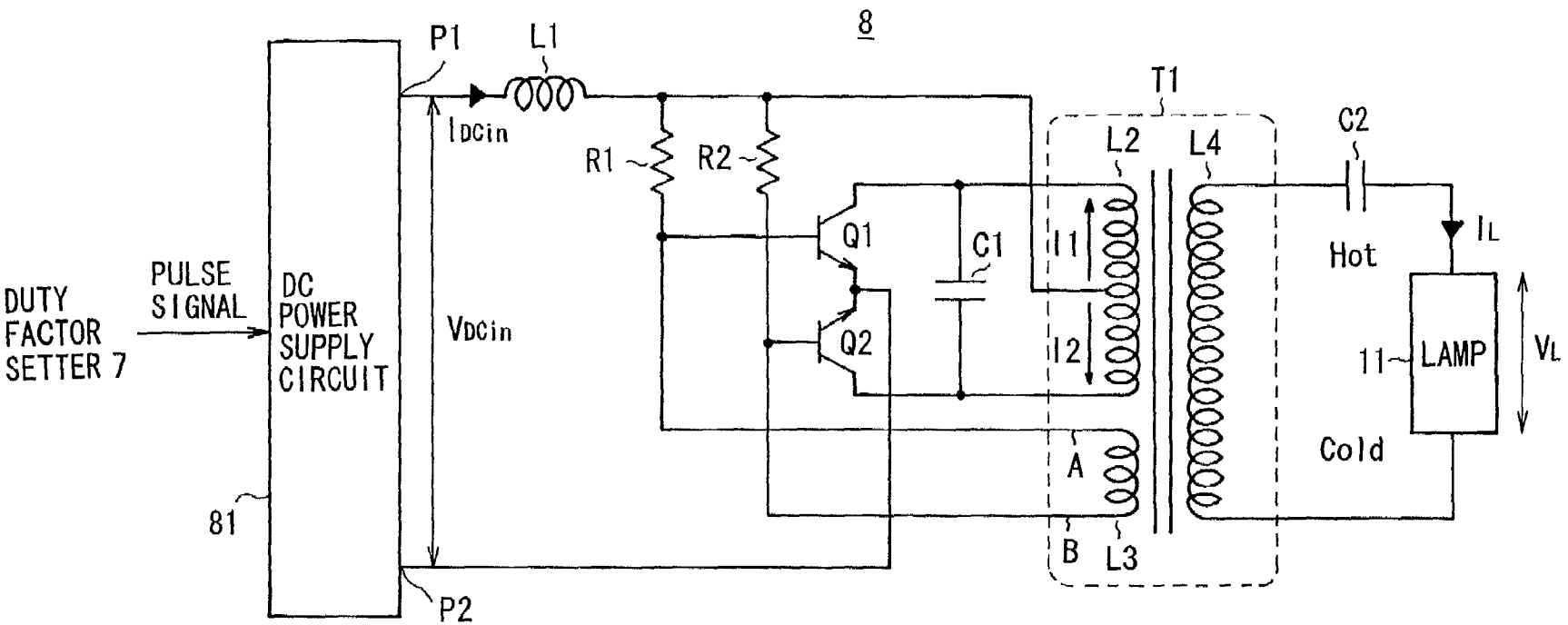
FIG. 8 is a circuit diagram of the inverter 8 for driving the lamp 11 of the backlight 3 used in the present invention.

FIG. 8 is a circuit diagram of the inverter 8 for driving the lamp 11 of the backlight 3 used in the present invention. The inverter 8 is a circuit that converts a DC (direct-current) voltage applied across the input terminals thereof into an AC (alternating-current) voltage and then steps it up.

First, the circuit configuration of the inverter 8 will be described. The inverter 8 has a DC power supply circuit 81 provided as its input stage. The DC power supply circuit 81 outputs a DC voltage $V_{DCin}$ that varies according to the duty factor of the pulse signal fed from the duty factor setter 7.

One output terminal P1 of the DC power supply circuit 81 is connected to one end of a coil L1. The other end of the coil L1 is connected to one end of each of two resistors R1 and R2, and also to the center tap of a primary coil L2 of a transformer T1. The other end of the resistor R1 is connected to the base of an NPN-type transistor Q1, and also to one end of a tertiary coil L3 of the transformer T1. The other end of the resistor R2 is connected to the base of an NPN-type transistor Q2, and also to the other end of the tertiary coil L3.

The transistors Q1 and Q2 have their emitters connected together, with the node between them connected to the other output terminal P2 of the DC power supply circuit 81. The collector of the transistor Q1 is connected to one end of a resonance capacitor C1, and also to one end of the primary coil L2. The collector of the transistor Q2 is connected to the other end of the resonance capacitor C1, and also to the other end of the primary coil L2.

The secondary coil L4 of the transformer T1 has one end connected through a ballast capacitor C2 to one end of the lamp 11, and has the other end connected to the other end of the lamp 11.

Next, the operation of the inverter 8 will be described. Now, suppose that the voltage at the terminal P1 is at a high level and the voltage at the terminal P2 is at a low level (for example, the ground level). When the transistor Q1 is off and the transistor Q2 is on at a given time, a current I1 flows through the resonance capacitor C1 and the transistor Q2 to the terminal P2, and thus the resonance capacitor C1 is charged. On the other hand, a current I2 flows through the transistor Q2 to the terminal P2.

However, as the resonance capacitor C1 is charged, the current I1 decreases, until eventually the voltage induced in the tertiary coil L3 turns the voltages at points A and B to a high and a low level, respectively. Now, the transistor Q1 is on and the transistor Q2 is off.

In this state, the current I1 flows through the transistor Q1 to the terminal P2. On the other hand, the current I2 flows through the resonance capacitor C1 and the transistor Q1 to the terminal P2, and thus the resonance capacitor C1 is charged in the opposite direction this time. However, as the resonance capacitor C1 is charged, the current I2 decreases.

This is repeated, and thereby an AC voltage is induced in the secondary coil L4. This induced voltage varies according to the DC voltage $V_{DCin}$ between the terminals P1 and P2. Accordingly, the amount of light emitted by the lamp 11 varies according to the DC voltage $V_{DCin}$. Moreover, as described previously, the DC voltage $V_{DCin}$ is so set as to become higher as the duty factor of the pulse signal fed from the duty factor setter 7 becomes higher, and therefore, as the duty factor of the pulse signal becomes higher, the amount of light emitted by the lamp 11 increases.

Here, the open output voltage of the transformer T1 must be equal to or higher than the lighting starting voltage of the lamp 11. Moreover, the lamp current $I_L$ varies according to the secondary voltage appearing in the secondary coil L4, and, if this secondary voltage is insufficient, the lamp 11 may flicker or even fail to be lit.

The ballast capacitor C2 is a capacitor that serves to limit the lamp current $I_L$. The higher the capacity of the ballast capacitor C2, the larger the lamp current $I_L$. By contrast, if the capacity of the ballast capacitor C2 is too low, it is susceptible to distributed capacitance.

The resonance capacitor C1 is a capacitor that forms, together with the transformer T1, a resonance circuit, and thus its capacitance affects the lighting frequency of the lamp 11. The higher the lighting frequency, the more current leakage is likely.

Figure 9:
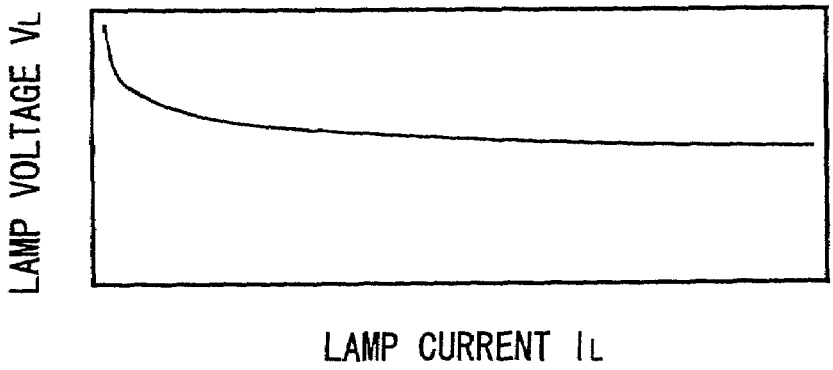
FIG. 9 is a diagram showing a typical relationship between the lamp current $I_L$ and the lamp voltage $V_L$ of the backlight 3 in a transmissive liquid crystal display device.
Figure 10:
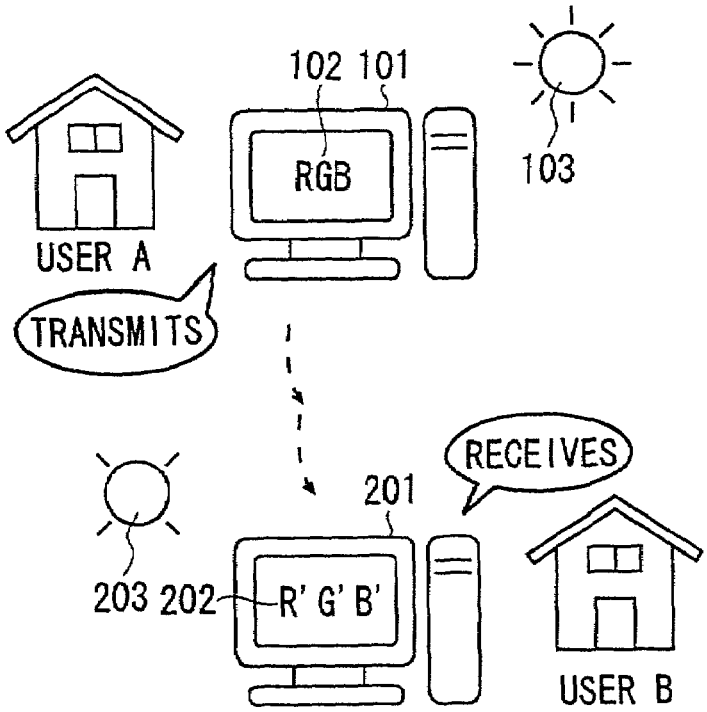
FIG.10 PRIOR ART
FIG. 10 is a diagram illustrating a case in which identical images displayed on different personal computers in different environments are observed by the use of a color management system.
Figure 11:
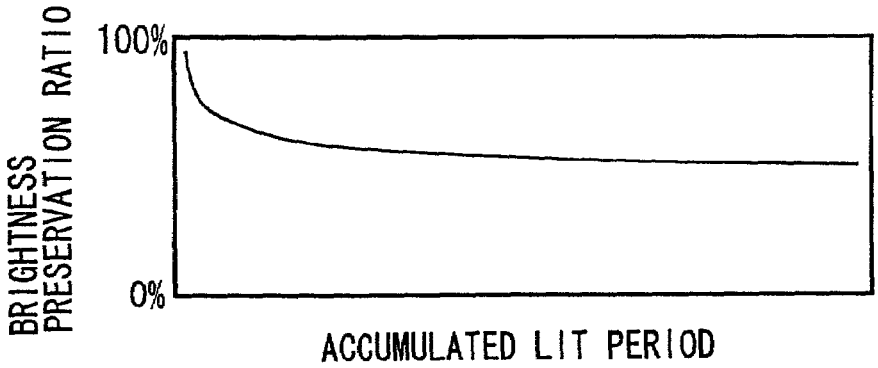
FIG.11 PRIOR ART
FIG. 11 is a diagram showing a typical pattern of the variation with time of the brightness (the brightness preservation ratio) of the backlight of a transmissive liquid crystal display device.
Figure 12:
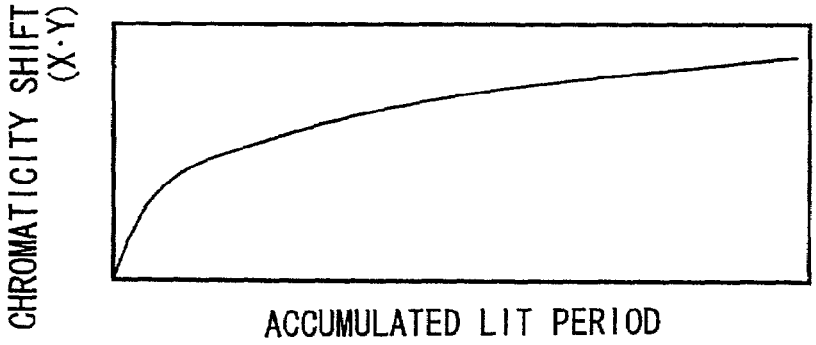
FIG.12 PRIOR ART
FIG. 12 is a diagram showing a typical pattern of the variation with time of the chromaticity (the chromaticity shift) of the backlight of a transmissive liquid crystal display device.

FIG. 9 is a diagram showing a typical relationship between the lamp current $I_L$ and the lamp voltage $V_L$ of the backlight 3 of the transmissive liquid crystal display device. In this figure, along the horizontal axis is taken the lamp current $I_L$, and along the vertical axis is taken the lamp voltage $V_L$. As shown in this figure, there exists a predetermined correlation between the lamp current $I_L$ and the lamp voltage $V_L$. Thus, this figure shows that, to achieve correction of the brightness or chromaticity of the backlight 3 as described above, either of the two parameters, i.e. the lamp current $I_L$ or the lamp voltage $V_L$, needs to be controlled.

Suppose that, on a sender-side personal computer, the brightness of an image is corrected by using a model BS120 or BS520 silicon photodiode (manufactured by Sharp Corporation) with a limited viewing angle. Then, a comparison between a case where the image is transmitted to a receiver-side personal computer with a brightness-corrected image signal and a case where the image is transmitted to the receiver-side personal computer without a brightness-corrected image signal verifies that a higher degree of brightness or chromaticity matching between the images displayed on the sender-side and receiver-side personal computers is achieved in the former case.

Embodiment 3

Subjective evaluation of image quality was conducted in the following manner. The data of a color image created on a digital still camera was transmitted by e-mail from one (sender-side) personal computer incorporating a transmissive liquid crystal display device embodying the invention to another (receiver-side) personal computer incorporating a transmissive liquid crystal display device embodying the invention, where the received data is stored in a HDD device and is then output as a color image. A plurality of observers compared the two images and evaluated the degree of matching on a scale from 1 to 5 points. For comparison, similar subjective evaluation of image quality was conducted also by using, as the receiver-side personal computer, one incorporating a conventional transmissive liquid crystal display device having no optical sensor 2 for brightness measurement fitted thereto.

Thus, the plurality of observers evaluated the following three images: the image displayed on the sender-side personal computer incorporating a transmissive liquid crystal display device embodying the invention (i.e. the image to be transmitted to the receiver-side personal computer), the image displayed on the receiver-side personal computer incorporating a transmissive liquid crystal display device embodying the invention, and the image displayed on the receiver-side personal computer incorporating a conventional transmissive liquid crystal display device. Here, as the image transmitted by e-mail for evaluation were used each of the following types of image: a person shot indoors, two persons shot indoors, a landscape, a person shot outdoors, two persons shot outdoors, a sporting scene, etc.

As a result of such subjective evaluation of image quality, with any type of image, the received image displayed on the transmissive liquid crystal display device embodying the invention was given a higher mark than the received image displayed on the conventional transmissive liquid crystal display device. Moreover, almost no difference was recognized between the image displayed on the sender-side personal computer incorporating the transmissive liquid crystal display device embodying the invention (i.e. the image to be transmitted to the receiver-side personal computer) and the image displayed on the receiver-side personal computer incorporating the transmissive liquid crystal display device embodying the invention.

In this way, color mismatching between a sender-side and a receiver-side image was overcome through color evaluation of the images on the monitors of personal computers. It was verified that this yielded better image quality than a conventional color management system and that using common colors helped eliminate differences in colors from one personal computer to another.

Variations in ambient-light conditions were canceled by making observations at the identical location. This eliminated the possibility that variations in ambient-light conditions would cause a change in the appearance of the image and destroy color matching. In general, when a transmissive liquid crystal display device is used for an extended period, variations with time in the characteristics of the color filter and variations with ambient temperature or with time in the characteristics of the backlight source are inevitable. However, with the transmissive liquid crystal display device embodying the invention, satisfactory color matching was achieved in the image displayed thereon despite variations as mentioned above so that its colors appeared correct.

As described above, in a transmissive liquid crystal display device according to the invention, variations with time in the characteristics of the color filter and variations with ambient temperature or with time in the characteristics of the backlight source are collectively corrected by controlling the lighting of the backlight source. This makes it possible to correct brightness or chromaticity or both simply by controlling a single parameter (the driving voltage or driving current of the backlight source), and thus makes designing of a system easy.

What is claimed is:

1. An image display device, comprising:

a liquid crystal panel for displaying an image including RGB colors;

a light source for emitting light toward the liquid crystal panel that the liquid crystal panel receives and uses for display operation thereof;

at least one optical sensor having a light receiving area corresponding to at least one pixel including R (red), G (green) and B (blue) dots, the optical sensor being arranged immediately above at least one color filter and thus over at least the R, G and B dots for measuring how the liquid crystal panel is emitting R, G, and B light, wherein the R, G and B light emitted by the liquid crystal panel are measured independently from one another by the at least one optical sensor;

a temperature sensor and a lamp temperature circuit for determining a temperature of the light source;

wherein light emission of the light source is controlled according to a measurement value obtained from the at least one optical sensor in order to correct brightness or chromaticity or both of the liquid crystal panel, and also based upon the temperature of the light source as determined by the temperature sensor and the lamp temperature circuit;

wherein a viewing angle of the optical sensor is limited and a measurement area of the optical sensor depends on the viewing angle; and wherein the measurement area of the optical sensor is within 10 degrees upward, downward, leftward, and rightward of a line perpendicular to the liquid crystal panel.

2. An image display device as claimed in claim 1, wherein the optical sensor has a light-sensing area at least equal to areas of one R, one G and one B dots added together.

3. An image display device as claimed in claim 1, wherein the brightness and/or chromaticity of the liquid crystal panel is corrected by controlling a driving voltage or driving current of the light source.

4. An image display device as claimed in claim 1, wherein the light source is part of a backlight provided at the back of the liquid crystal panel.

5. An image display device as claimed in claim 1, wherein the RGB image is displayed by receiving image data transmitted from a transmitting side.

6. An image display device as claimed in claim 1, further comprising:

a temperature sensor for measuring surface temperature of the light source, wherein the driving voltage or driving current of the light source is controlled in such a way that the surface temperature of the light source is kept constant.

7. An image display device as claimed in claim 6, wherein the temperature sensor is a thermistor whose resistance varies with the surface temperature of the light source.

8. The image display device of claim 1, wherein said optical sensor for measuring how the liquid crystal panel is emitting R, G, and B light is located directly on a face of the liquid crystal panel.

9. The image display device of claim 1, further comprising duty factor setter means for setting a duty factor of a pulse signal in such a way that, when the difference between a current and a specified brightness values is negative, lamp current supplied to the light source is increased to eliminate the difference and, when the difference is positive, the lamp current is decreased to eliminate the difference.

10. An image display device comprising:

a liquid crystal panel for displaying an image;

a backlight for illuminating the liquid crystal panel from behind;

an optical sensor having a light receiving area corresponding to at least one pixel including R (red), G (green) and B (blue) dots, the optical sensor being arranged immediately above at least one color filter and thus over at least the R, G and B dots, the sensor including first, second and third separate and distinct functions for measuring how the liquid crystal panel is emitting R (red), G (green), and B (blue) light, respectively, so that R, G and B light output from the liquid crystal panel is measured independently;

a signal reading circuit for converting measurement values obtained from the optical sensor into a current brightness value of the liquid crystal panel;

a brightness setting circuit for permitting entry of specified brightness of the liquid crystal panel;

a converting circuit for converting an output of the brightness setting circuit into a specified brightness value of the liquid crystal panel;

a calculator for calculating a difference between the current brightness value and the specified brightness value of the liquid crystal panel;

a duty factor setting circuit for outputting a pulse signal whose duty factor depends on an output of the calculator;

an inverter for producing a driving voltage and a driving current for the backlight according to the pulse signal, wherein the brightness of the liquid crystal panel is corrected by controlling light emission of the backlight according to the measurement value obtained from the optical sensors, and wherein the optical sensor is located immediately above at least one color filter and thus over at least the R, G and B dots, so that all light emitted from the R, G and B dots of the pixel is first collectively captured by the sensor and then from the different wavelength components thereof the R, G and B components are separately detected and measured independently.

11. An image display device as claimed in claim 10, further comprising:

said signal reading circuit for converting measurement values obtained from the optical sensor into a current brightness value and a current chromaticity value of the liquid crystal panel;

a thermistor whose resistance varies with surface temperature of the backlight;

a temperature reading circuit for converting the resistance of the thermistor into a surface temperature value of the backlight; and converting means for converting an output of the temperature reading circuit into a specified brightness value of the liquid crystal panel, wherein brightness and chromaticity of the liquid crystal panel are corrected by controlling light emission of the backlight according to the measurement values obtained from the optical sensor in such a way that the surface temperature of the backlight is kept constant.

12. The image display device of claim 10, wherein said optical sensor is located directly on a face of the liquid crystal panel.

13. An image display device, comprising:

a liquid crystal panel for displaying an image including RGB colors;

a light source for emitting light toward the liquid crystal panel that the liquid crystal panel receives and uses for display operation thereof;

at least one optical sensor having a light receiving area corresponding to at least one pixel including R (red), G (green) and B (blue) dots, the optical sensor being arranged immediately above at least one color filter and thus over at least the R, G and B dots for measuring how the liquid crystal panel is emitting R, G, and B light, wherein the R, G and B light emitted by the liquid crystal panel are measured independently from one another by the at least one optical sensor;

a temperature sensor and a lamp temperature circuit for determining a temperature of the light source;

wherein light emission of the light source is controlled according to a measurement value obtained from the at least one optical sensor in order to correct brightness or chromaticity or both of the liquid crystal panel, and also based upon the temperature of the light source as determined by the temperature sensor and the lamp temperature circuit; and wherein the optical sensor is located immediately above at least one color filter and thus over at least the R, G and B dots, so that all light emitted from the R, G and B dots of the pixel is first collectively captured by the sensor and then from the different wavelength components thereof the R, G and B components are separately detected and measured independently.

14. An image processing device including a display panel and a light source that emits light that is received and used by the display panel to produce an image, comprising:

at least one sensor having a light receiving area corresponding to at least one pixel including R (red). G (green) and B (blue) dots, the optical sensor being arranged immediately above at least one color filter and thus over at least the R, G and B dots for measuring how R, G and B light is emitted from the display panel, wherein R. G and B light emitted from the display panel are measured by the at least one sensor independently from one another;

wherein brightness or chromaticity or both of image(s) output from the display panel is corrected by controlling light emission of the light source according to a measurement value obtained from the at least one sensor; and wherein the optical sensor is located immediately above at least one color filter and thus over at least the R, G and B dots, so that all light emitted from the R, G and B dots of the pixel is first collectively captured by the sensor and then from the different wavelength components thereof the R, G and B components are separately detected and measured independently.

15. The image processing device of claim 14, wherein said sensor is located directly on a face of the display panel.

* * * * *